US009303494B2

(12) United States Patent
Pasvandi

(10) Patent No.: US 9,303,494 B2
(45) Date of Patent: Apr. 5, 2016

(54) CUTTING UNIT OF A HYDROMECANICAL SLOT PERFORATOR

(75) Inventor: Marie Pasvandi, Mesa Geitona (CY)

(73) Assignee: Passerby Inc., Providence (SC)

( * ) Notice: Subject to any disclaimer, the term of this patent is extended or adjusted under 35 U.S.C. 154(b) by 351 days.

(21) Appl. No.: 13/985,115

(22) PCT Filed: Feb. 9, 2012

(86) PCT No.: PCT/IB2012/000230
§ 371 (c)(1),
(2), (4) Date: Aug. 13, 2013

(87) PCT Pub. No.: WO2012/110867
PCT Pub. Date: Aug. 23, 2012

(65) Prior Publication Data

US 2013/0319651 A1 Dec. 5, 2013

(30) Foreign Application Priority Data

Feb. 14, 2011 (RU) ..... 2011105450

(51) Int. Cl.
*E21B 43/112* (2006.01)
*E21B 29/06* (2006.01)

(52) U.S. Cl.
CPC ..... *E21B 43/112* (2013.01); *E21B 29/06* (2013.01)

(58) Field of Classification Search
CPC ..... E21B 43/112; E21B 29/00; E21B 10/322; E21B 29/06; Y10T 408/38
See application file for complete search history.

(56) References Cited

U.S. PATENT DOCUMENTS 2,638,801 A * 5/1953 Klaasen ..... E21B 43/112 166/237
2,735,485 A * 2/1956 Metcalf, Jr. ..... E21B 10/322 15/104.12
3,050,122 A * 8/1962 Huitt ..... E21B 10/322 166/55.8
4,106,561 A * 8/1978 Jerome ..... E21B 29/00 166/55.2
4,119,151 A * 10/1978 Smith ..... E21B 29/00 166/298

(Continued)

FOREIGN PATENT DOCUMENTS

EA 009905 B1 * 4/2008
RU 2254451 C1 * 6/2005
RU 2348797 C1 * 3/2009

(Continued)

*Primary Examiner* — Daniel P Stephenson
(74) *Attorney, Agent, or Firm* — Aleksandr Smushkovich

(57) ABSTRACT

The proposed hydro-mechanical slot-type perforator enables simultaneously performing at least two slots in a production column. The perforator includes a casing, upper and lower pistons movable within the casing, a cutting unit driven by the pistons and carrying extendable cutting tools, and, optionally, a retractable mechanism fixing the perforator for transportation. The extension is provided by rotatable shackles, or balance beams, or a combination thereof. The lower piston is moved by pressurized fluid supplied through hydraulic channels or a hydraulic system, made in the casing. The shackles rotate around axles being spaced apart, or coincided. The cutting tools can be mounted on the shackles' movable parts, and, when mutually interacted, oppositely extend the cutting tools during countermovement of the pistons. The cutting tools can be mounted in the balance beam's shoulders, or can represent sharp edges thereof. The shackles and balance beams can have wedge-shaped portions, grooves, and connecting rods.

12 Claims, 6 Drawing Sheets

(56) References Cited

U.S. PATENT DOCUMENTS

| | | | | | |
|---|---|---|---|---|---|
| 5,036,921 | A * | 8/1991 | Pittard | E21B 29/005 | 166/298 |
| 5,201,817 | A * | 4/1993 | Hailey | E21B 10/322 | 166/55.8 |
| 5,385,205 | A * | 1/1995 | Hailey | E21B 10/60 | 166/55.8 |
| 8,899,313 | B2 * | 12/2014 | Pasvandi | E21B 43/112 | 166/298 |

FOREIGN PATENT DOCUMENTS

| | | | |
|---|---|---|---|
| RU | 100802 | U1 * | 12/2010 |
| RU | 2440486 | C1 * | 1/2012 |
| RU | 2538554 | C1 * | 1/2015 |
| RU | 2550629 | C1 * | 5/2015 |
| SU | 1337513 | A1 * | 9/1987 |

* cited by examiner

CUTTING UNIT OF A HYDROMECANICAL SLOT PERFORATOR

CROSS-REFERENCE TO RELATED APPLICATIONS

This application is a U.S. national stage application of a PCT application PCT/IB2012/000230 filed on 9 Feb. 2012, published as WO2012110867, whose disclosure is incorporated herein in its entirety by reference, which PCT application claims priority of a Russian Federation patent application RU2011105450 filed on 14 Feb. 2011.

FIELD OF THE INVENTION

The proposed invention relates to drilling and well operations, in particular to the design of devices for the opening of productive formations by hydromechanical slot perforation, and can be used in the construction and repair of wells for various purposes.

BACKGROUND OF THE INVENTION

In the prior art, there are known devices for slot perforation of wells disclosed in Russian Federation Patents RU 2205941 C2, IPC 7 E21B 43/112, 10.06.2003; RU 2244806 C1, IPC 7 E21B 43/112, 20.01.2005; RU 2254451 C1, IPC 7 E21B 43/112, 20.06.2005; RU 2239053 C1, IPC 7 E21B 43/114, 27 Oct. 2004, containing cutting tools in the form of rolling disks. However, when using these devices, the formation of perforated slots is performed only in one projection, which leads to the necessity to reorient the perforator after forming each perforation slot, and to make additional round-trip operations.

In the prior art, there is known a more efficient double sided hydromechanical slot-type perforator according to Russian Federation Patent RU 2249678 C2, IPC 7 E21B 43/112, 10 Apr. 2005, which allows to perform the drilling-in of wells simultaneously with formation of two diametrically opposite slots in the production string, containing the casing with cutting tools mounted in it in the form of two discs and the mechanism of their extension. At that the diameter of the cutting disc of mentioned perforator is close to the diameter of perforator's casing that allows making perforation slots with a considerable depth.

The disadvantage of this device is a non-uniform force application on the cutting discs, in virtue of which the upper cutting disc during opening of the column goes beyond its dimensions to the maximum distance, while the lower disc during opening exercises drilling-in less effectively, and therefore the second slot formed by it may not reach required width and depth, and after prolonged use of the perforator and wear of the lower disc can be absent at all.

The mentioned shortcoming is overcome to some extent in a device according to the Patent EA 009905 B1, IPC E21B 43/112, 28 Apr. 2008, which is herein further referred to as a 'prototype'.

The device according to the prototype is a hydromechanical slot-type perforator, comprising a casing with a piston-pusher placed in it and telescoping cutting tools in the form of cutting discs mounted on axes with the mechanism of their extension, with the possibility of cutting of two diametrically opposite slots, at that the drive mechanism includes a balance beams mounted on a central axis with cutting discs' axis installed in their arms, at that the balance beams are configured with the possibility of rotation when you move the piston-pusher, and jet nozzles, where the ratio of axial distances from the upper and lower cutting discs to the central axis is determined by the diameter of the column and equals 1.5-1.25.

The device, according to the prototype, due to an increase of axial distance from the lower cutting discs to the central axis provides a guaranteed yield of the lower exit out of production string and the formation of the second diametrically located slot by the lower cutting disk.

However, the prototype device has the following disadvantages:

1. Persisting uneven force application to the cutting disks: force of the piston is primarily applied to the upper blade, and only indirectly to the lower blade.
2. The same quality of column opening by means of both the cutting disks is not provided.
3. Discs are worn unevenly, that after prolonged use leads to an increase in the number of additional round-trip operations necessary to replace the disc.

SUMMARY OF THE INVENTION

The objective of the proposed invention is to create designs of the perforator, providing a uniform opening of the production string at the same time in at least two projections to ensure the building of diametrical slots are equally high quality.

The proposed invention achieves the following technical result:

1. Improving the uniformity, quality and speed of opening of the production string, improving performance punch.
2. Reducing the probability of fractures and strains of perforator's moving parts.
3. Reducing the probability of jamming of the cutting in the slots.
4. The uniformity of wear of cutting tools and reduced rate of wear.
5. Improving the reliability of perforator.

The mentioned technical result is achieved through an inventive design, providing equalization of forces applied to the perforator's cutting tools by providing the perforator with an extra piston to be placed in the casing below the cutting unit, with the possibility to apply this lower piston's additional effort to the cutting unit that is directed oppositely to force, generated by the upper piston, thus acting mainly on the extension mechanism of the lower cutting tool.

A first embodiment of the device included in the proposed invention represents a hydro-mechanical slot-type perforator for making slots in a production column; the perforator comprises a casing with a piston-pusher (also called an 'upper piston' herein below) placed in the casing and capable of moving therein; and a cutting unit located below the upper piston, which cutting unit includes telescoping cutting tools with an extension mechanism, in the form of a balance beam having shoulders, in which shoulders the cutting tools are located, wherein the balance beam is mounted in the casing with the possibility of rotation around an axle during the moving down of the upper piston, while the cutting tools are simultaneously performing at least two slots in the production column. According to the first embodiment of the invention, the perforator is provided with an additional lower piston, placed in the casing below the cutting unit with the ability of this lower piston, as it moves up, to apply an additional force to the lower shoulder of the balance beam that carries a lower cutting tool, at that the upward stroke of the lower piston is provided by an action of fluid coming under pressure, for example, through one or more hydraulic channels executed in the casing of the perforator, or otherwise through a hydraulic system, executed in the perforator.

A second embodiment of the device included in the proposed invention represents a hydro-mechanical slot-type perforator for making slots in a production column. The perforator comprises a casing with a piston-pusher (also simply called 'piston' herein below) placed in the casing and capable of moving therein; and a cutting unit located below the piston, which cutting unit includes two telescoping cutting tools with an extension mechanism with the ability of cutting tools to perform simultaneously at least two slots in the production column. The extension mechanism further includes two balance beams shaped as shackles, each having shoulders, wherein each such shoulder contains one of the cutting tools; the balance beams each is pivotable around an axle, i.e. the upper and lower shackles are capable of rotation under pressure applied thereto. According to the second embodiment of the invention, the perforator is provided with an additional lower piston, placed in the casing below the cutting unit with the ability of this lower piston to move within the casing, and, as it moves up, to apply an additional force to the lower shoulder of the lower balance beam that carries the lower cutting tool; at that the upward stroke of the lower piston is provided by an action of fluid coming under pressure, for example, through one or more hydraulic channels executed in the casing of the perforator, or through a hydraulic system, executed in the perforator in another manner.

The second embodiment of the invention contemplates the independent extension of the upper and lower cutting tools under the action of the upper and lower pistons, respectively. Such design of the cutting tools extension mechanism additionally reduces the probability of their jamming.

The axles of rotation of the shackles' moving parts can be located on the same line, which is perpendicular to the longitudinal axis of the perforator. This reduces the distance between the upper and lower cutting tools, that provides a more compact arrangement of the cutting tools in the perforator and more uniform opening of the production column with a reduced height difference between the slots being formed.

The axles of rotation of the shackles' moving parts can optionally coincide (e.g. the shackles can have one common axle), while the shackles are mounted with the possibility of rotation of their moving parts independently of each other. It also provides a more compact arrangement of the cutting tools and more uniform opening of the production column with a reduced height difference between the slots being formed.

A third embodiment of the proposed invention represents a hydro-mechanical slot-type perforator, comprising: a casing; an upper piston movable within the casing; and a cutting unit located below the upper piston. The cutting unit includes telescoping cutting tools with an extension mechanism with the ability of the cutting tools to perform simultaneously at least two slots in the production string. According to the third embodiment of the invention, the perforator is provided with an additional lower piston, movable within the casing, placed in the casing below the cutting unit with the ability of this lower piston, as it moves up, to apply an additional force to the cutting unit; at that the upward stroke of the lower piston is provided by an action of fluid coming under pressure, for example, through one or more hydraulic channels executed in the casing of the perforator, or through a hydraulic system, executed in the perforator in another manner; wherein the extension mechanism of cutting tools includes an upper wedge-type shackle and a lower wedge-type shackle, rotatably mounted oppositely to each other on the upper and lower pistons respectively; each such shackle has a movable part with a wedge-shaped portion (herein also called a 'V-surface'); the cutting tools are mounted on the oppositely directed movable parts of the shackles, made with the possibility of interaction and movement relative to each other, with the extension of the cutting tools in the opposite direction during counter-movements of the pistons.

The design of cutting tools extension mechanism offered in the third embodiment of the invention, provides the closest location of the cutting tools relative to each other, and provides the most uniform opening of the production column with the minimum height difference between the slots being formed. In this case, the independent extension of the upper and lower cutting tools under the action of the upper and lower pistons, respectively, reduces the probability of jamming of the cutting tools in the formed slots.

The perforator of the third embodiment may also include a mechanism for bringing the retractable (movable) parts into a transport position. Such retractable mechanism includes, for example, a guide groove, executed in one of the wedge-type shackles, and a connecting rod, attached to the other wedge-type shackle or to the piston it's mounted to; wherein the connecting rod is configured to move along the guide groove and thereby ensuring the return of wedge-type shackles into the transportation position during the reverse movement of the pistons. The retractable mechanism improves the performance of the perforator, makes it easier to bring it into the transportation position and simplifies its extraction from the well at the end of the work, as well as helps to avoid jamming and fracture of the cutting tools.

A fourth embodiment of the proposed invention represents a hydro-mechanical slot-type perforator, comprising a casing with an upper piston movable within the casing; and a cutting unit located below the upper piston; the cutting unit includes telescoping cutting tools with an extension mechanism. Such perforator has the ability of the cutting tools to produce simultaneously at least two slots in the production column.

According to the fourth embodiment of the invention, the perforator is provided with an additional lower piston, placed in the casing below the cutting unit with the ability of this lower piston, as it moves up, to apply an additional force to the cutting unit, at that the upward stroke of the lower piston is provided by an action of fluid coming under pressure, for example, through one or more hydraulic channels executed in the casing of the perforator, or through a hydraulic system, executed in the perforator in another manner. The perforator comprises a cutting unit including cutting tools and an extension mechanism of the cutting tools. The extension mechanism includes upper and lower wedge-type shackles, pivotable around axles, with rotatable parts having wedge-shaped portions (V-surfaces); the rotatable parts of the shackles are mounted oppositely to each other on the upper and lower pistons respectively. The extension mechanism includes at least one wedge-type balance beam, placed between the wedge-type shackles, each having a wedge-shaped portion (a V-surface), while the balance beam(s) is (are) made with the ability to turn during interaction of its (their) V-surfaces with the V-surfaces of the wedge-type shackles (or the interaction of the respective V-surfaces of the wedge-type shackles with other balance beams, if any). The balance beams each has two shoulders. The cutting tools are mounted on the oppositely directed movable parts of the wedge-type shackles, as well as in the wedge-type balance beam's shoulders, with the possibility of extension in opposite directions during a counter-movement of the pistons.

The perforator of the fourth embodiment of the invention has a cutting unit, comprising more than two cutting tools, oriented in opposite directions, capable of simultaneous formation of slots in the productive column. The proposed design of the cutting tools extension mechanism can significantly speed up the formation of slots due to the simultaneous extension of four, six, or more cutting tools, in this case. Due to sufficient proximity of the cutting tools, the inventive device has a compact size in comparison with known devices including more than two cutting tools (RU 2371569 C1, IPC E21B 43/112, 27 Oct. 2009, RU 86654 U1, IPC E21B 43/112, 10 Sep. 2009).

The perforator of the fourth embodiment may include a mechanism to bring the retractable parts into a transportation position. Such retractable mechanism may, for example, comprise one or more guide grooves made in the wedge-type shackles and/or in the balance beam, as well as one or more connecting rods, attached to the respective wedge-type shackle and/or to the beam, made to be movable along the groove (grooves) and thereby ensuring the return of the shackle and the balance beam into the transportation position during the reverse movement of the pistons. The presence of such a mechanism in the perforator, (like in the third embodiment of the invention), improves the performance of the perforator, makes it easier to bring it into the transportation position and simplifies its extraction from the well at the end of the work, as well as helps to avoid jamming and fracture of the cutting tools.

All four embodiments of the inventions can improve performance and reliability of the inventive perforator compared to the prototype.

The additional piston, located below the cutting unit, transmits the fluid pressure to the cutting unit from the bottom, creating a force opposite to that created by the upper piston. Mostly, the additional force of the piston applies to the extension mechanism of the lower cutting tool, thus the force applied to the lower cutting tool is equalized with respect to the force that acts on the upper cutting tool, that provides a uniform penetration of the cutting tools in the column in the process of opening thereof. This ensures uniform operation of the lower and upper cutting tools that allows to prevent their jamming and accidents, as well as provides for their uniform wear. Application of the present invention allows securely opening the column in two projections, at that the slots formed in the two projections have the same qualitative characteristics.

Cutting tools in the proposed embodiments of the device may be executed in the form of discs (mills) mounted on axles, as in the prototype, as well as in other shapes and forms (knives, cutters, etc.). In addition, the cutting tools can be implemented in appropriate ways directly on the balance beam, on the moving parts of the wedge-type shackles, on the wedge-type balance beam, for example, in the form of the balance beam's edge, or the edge of the movable part of the wedge-type shackle, treated a certain way to provide cutting properties, for example, sharpened, or fitted with hard alloy inserts.

The perforator of any of the four proposed embodiments can be equipped with two or more jet nozzles, performed, for example, in the casing and/or in the perforator's pistons. This allows executing a jetting process of the bottom-hole formation zone in the perforation interval immediately following the opening of the column without the use of additional equipment and without the use of additional descending-ascending operations.

The claimed device has a simple design, which ensures the reliability and manufacturability thereof.

BRIEF DESCRIPTION OF DRAWINGS OF THE INVENTION

On Figures, there are shown six embodiments of the claimed invention with the cutting tools in the form of discs.

DETAIL DESCRIPTION OF PREFERRED EMBODIMENTS OF THE INVENTION

Figure 1:
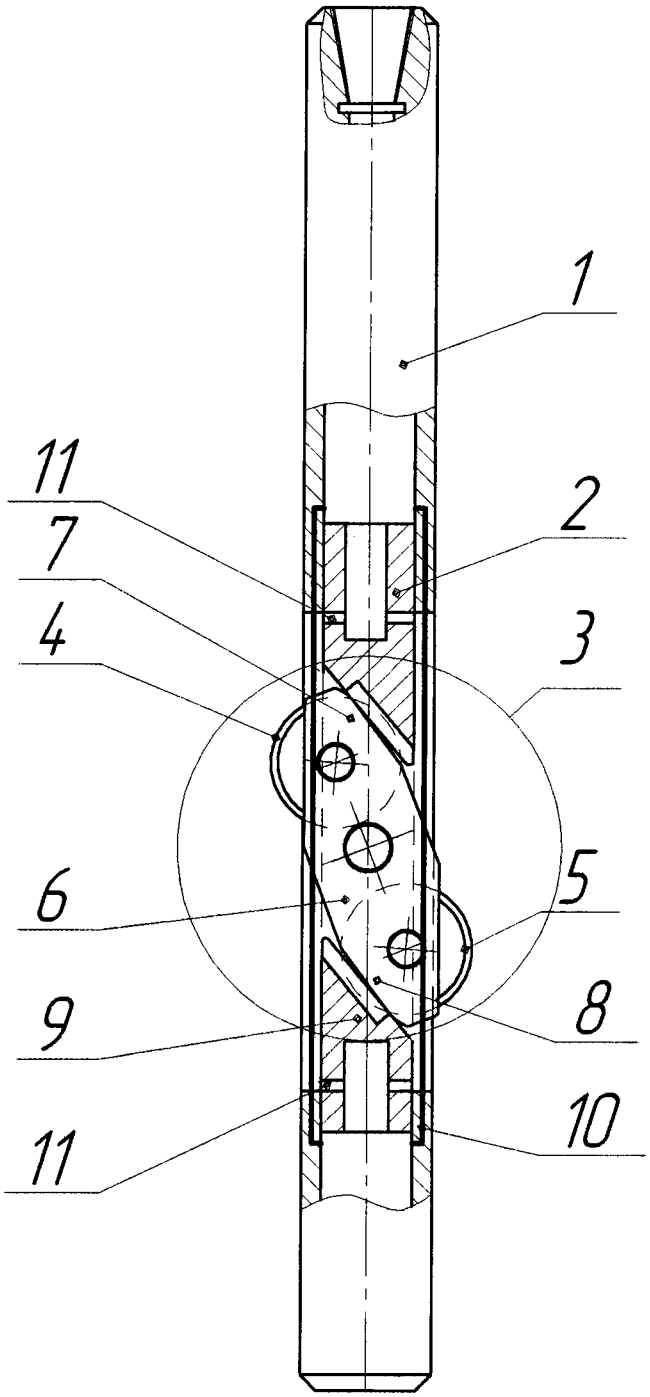
FIG. 1 illustrates the first embodiment of the invention, with the extension mechanism of cutting tools in the form of the balance beam.

While the invention may be susceptible to embodiment in different forms, there is shown in the drawing, and will be described in detail herein, a specific embodiment of the present invention, with the understanding that the present disclosure is to be considered an exemplification of the principles of the invention, and is not intended to limit the invention to that as illustrated and described herein.

According to the first embodiment of the invention (FIG. 1), a hydro-mechanical slot-type perforator comprises a casing 1, an upper piston 2 placed therein, and a cutting unit 3 located below the piston 2, which cutting unit 3 includes telescoping cutting tools 4, 5 (an upper cutting tool 4 and a lower cutting tool 5), with an extension mechanism in the form of a balance beam 6, having two shoulders 7 and 8, while the cutting tools 4, 5 are mounted respectively in the shoulders 7, 8; at that the balance beam 6 is mounted with the possibility of rotation around an axle during a downward stroke of the upper piston 2 and simultaneous forming of at least two slots in the production column by the cutting tools 4, 5. As shown in FIG. 1, the pistons 2 and 9 preferably have skewed work surfaces providing for efficient cooperation with the respective surfaces of shoulders 7 and 8 receiving pressure from the pistons during contacting therewith. The perforator is equipped with an additional lower piston 9, placed in the casing 1 below the cutting unit 3, with the ability of the lower piston 9, during its upward stroke, to create an additional force applied on the lower shoulder 8 that carries the lower cutting tool 5, at that the movement of the lower piston 9 is provided by action of fluid coming to it under pressure, for example, through one or more hydraulic channels 10, made in the perforator's casing 1, or through a hydraulic system (not shown), arranged in another manner.

The perforator can be equipped with two or more jet nozzles 11, made, for example, in the casing 1 and/or in the pistons 2, 9.

Figure 2:
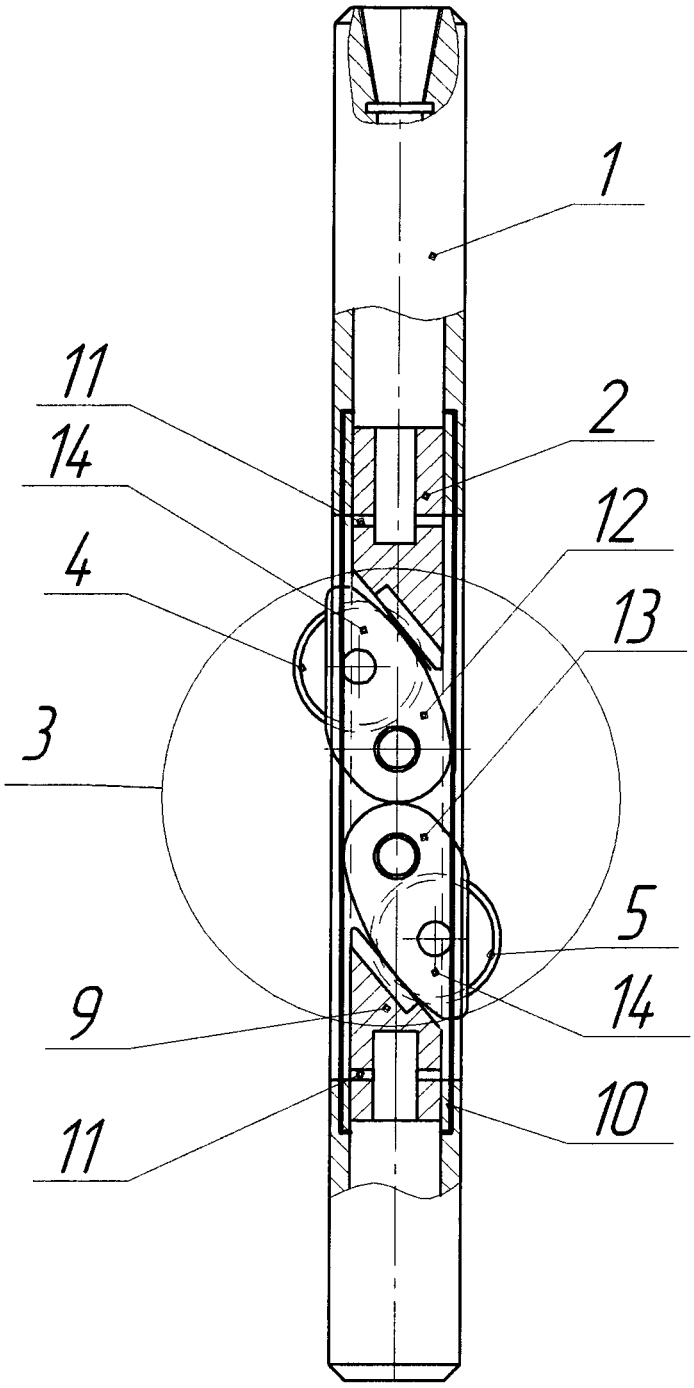
FIG. 2 illustrates the second embodiment of the invention, with the extension mechanism of cutting tools in the form of shackles, interacting with the pistons.

According to the second embodiment of the invention (FIG. 2), the extension mechanism of cutting tools includes an upper shackle 12 and a lower shackle 13; wherein the shackles have movable parts 14, and the shackles 12 and 13 are mounted in the casing 1 with the possibility of rotation of their movable parts 14 under the action of the upper 2 and lower 9 pistons upon these two movable parts respectively. The cutting tools 4, 5 are mounted on the movable parts 14 of the shackles 12, 13 correspondingly.

Figure 3:
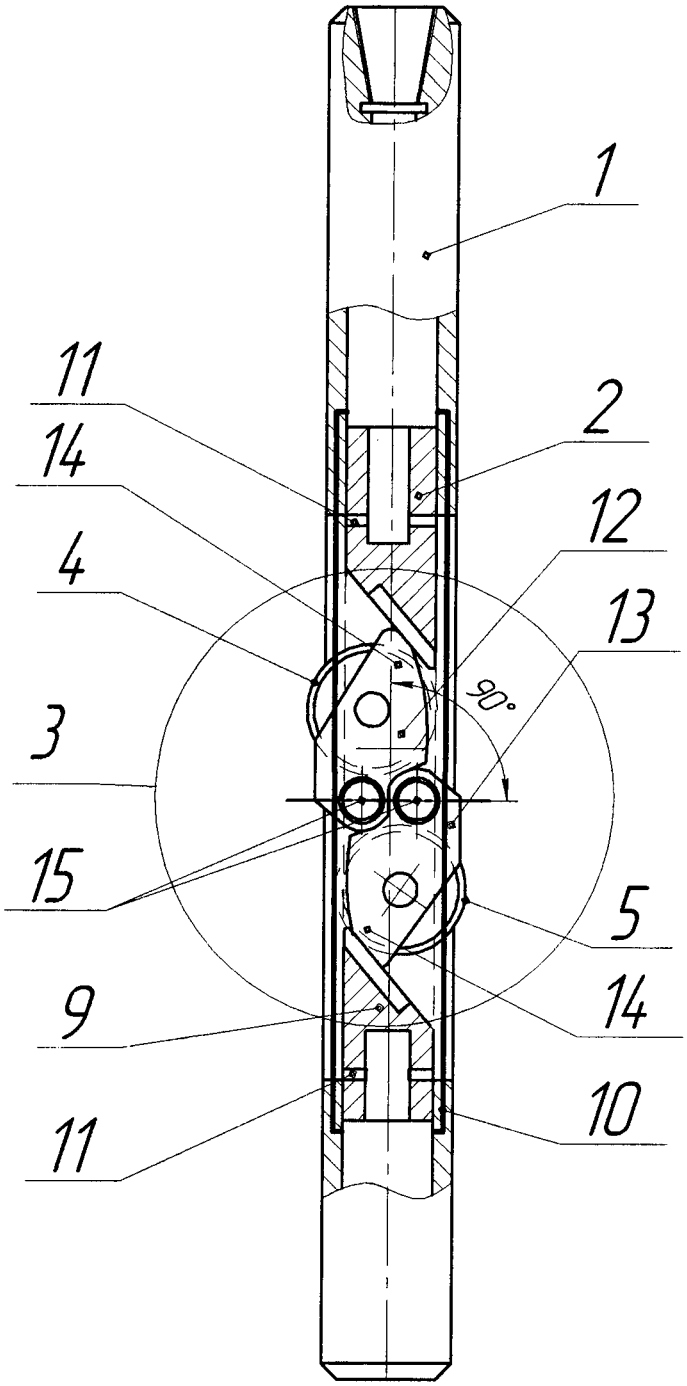
FIG. 3 illustrates an optional sub-embodiment of the second embodiment, depicting the extension mechanism for the cutting tools with the location of the rotational axles of the shackles along one line, which is perpendicular to the longitudinal axis of the perforator.
Figure 4:
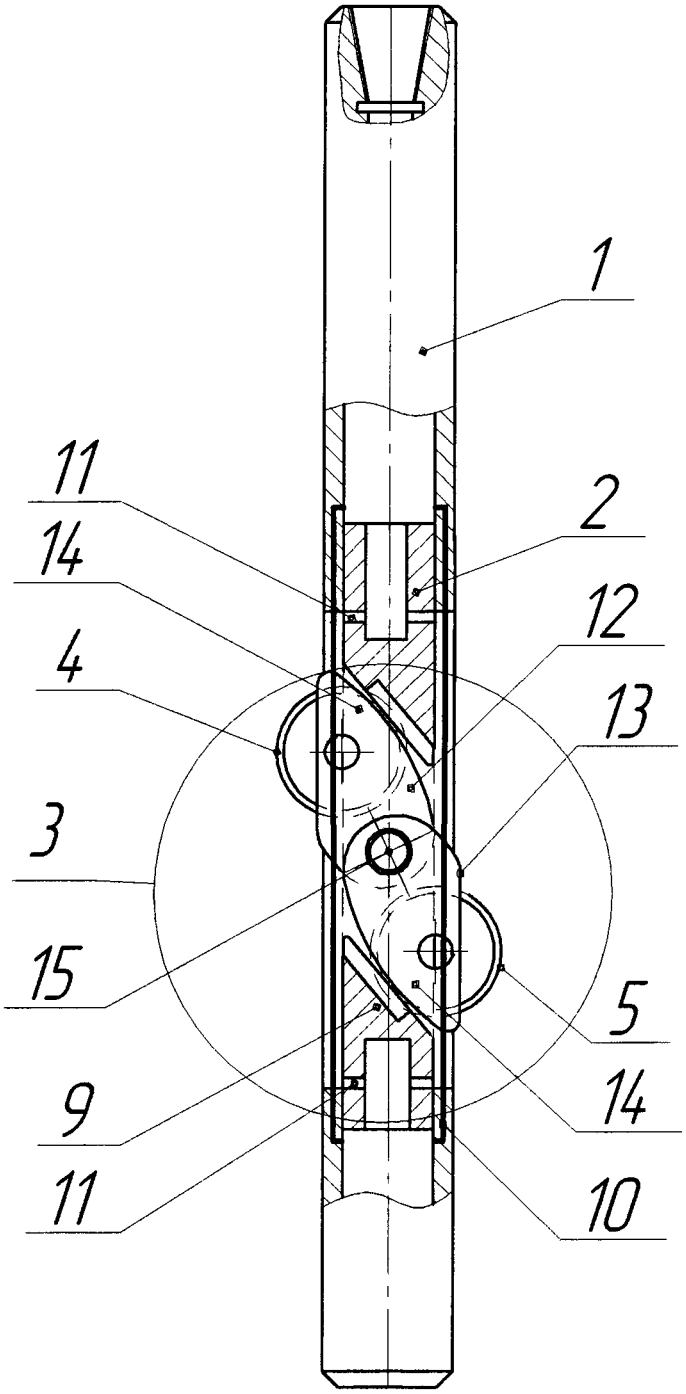
FIG. 4 illustrates an optional sub-embodiment of the second embodiment, depicting the extension mechanism for the cutting tools, wherein the rotational axles of the shackles coincide, and the moving parts of the shackles can rotate independently of each other.

The shackles 12 and 13 have respective axles 15 of rotation of their movable parts 14. The axles 15 may be located on the same line, which is perpendicular to the longitudinal axis of the perforator (FIG. 3). The axles 15 may optionally coincide (for example, forming one common axle), while their movable parts 14 can rotate independently (FIG. 4).

According to the third embodiment of the invention (FIG. 5), the extension mechanism of the cutting tools 4, 5 includes an upper wedge-type shackle 16 and a lower wedge-type shackle 17, having movable parts 18; the shackles 16 and 17 are mounted oppositely to each other on the upper piston 2 and on the lower piston 9 respectively, with the possibility of rotation of their movable parts 18; at that the cutting tools 4, 5 are mounted on the oppositely directed movable parts 18 of the shackles 16 and 17. The shackles 16 and 17 have wedge-shaped ending portions 19 ('V-surfaces'), made with the possibility of interaction and movement relative to each other with the extension of the cutting tools 4 and 5 in opposite directions during a countermotion of the pistons 2, 9.

According to the fourth embodiment of the invention (FIG. 6), the extension mechanism of the cutting tools 4, 5 includes an upper wedge-type shackle 16 and a lower wedge-type shackle 17, having movable parts 18 with ending V-surfaces portions 19, and mounted oppositely to each other on the upper piston 2 and the lower piston 9 respectively with the possibility of rotation of the movable parts 18; the extension mechanism includes at least one wedge-type balance beam 20, having shoulders, placed between the wedge-type shackles 16, 17, each having a V-surface 21, made with the possibility of rotation during the interaction of its (their) V-surfaces 21 with V-surfaces 19 of wedge-type shackles 16, 17 (wedge-type shackles 16, 17 and/or other balance beams 20); the cutting tools 4, 5 are mounted on the oppositely directed movable parts 18 of wedge-type shackles 16, 17 as well as in the shoulders of the respective wedge-type balance beam (wedge-type balance beams) 20, with the possibility of extension in opposite directions during a countermotion of the pistons 2 and 9.

The perforator of the third and fourth embodiments may contain a mechanism to bring retractable (movable) parts thereof into a transportation position. Such retractable mechanism may, for example, include one or more guide grooves 22, arranged in the wedge-type shackles 16, 17 and/or in the balance beam 20, and one or more connecting rods 23, attached to the respective shackle, or to the piston 2, 9 supporting the respective shackle, and/or to the balance beam 20, made to be movable along the groove (grooves) 22, and thereby ensuring the return of wedge-type shackles 16, 17 and the balance beam (balance beams) 20 into the transportation position during a countermotion of the pistons 2 and 9.

OPERATION AND APPLICABILITY OF THE INVENTION

The device operates as follows. The perforator is lowered into the well on the production string (tubing), it's then linked to the perforation interval, and the other preparatory works are performed by known methods. Then working pressure is created in the production string, under the action of which the working fluid begins to act upon the upper piston 2, and, flowing through hydraulic channels 10 in the perforator's casing 1 to the lower piston 9, begins acting upon the lower piston 9. Under the action of fluid, the pistons 2 and 9 are moving steadily along the axis of the device towards each other in the direction to the cutting unit 3, located between them. The pistons 2, 9, activate the extension mechanism of the cutting tools 4, 5.

According to the first embodiment of the device, the upper piston 2 acts on the upper shoulder 7 of the balance beam 6 that carries the upper cutting tool 4, and the lower piston 9 acts on the lower shoulder 8 of the balance beam 6 that carries the lower cutter 5. Under the action of the pistons 2, 9, the balance beam 6 turns and the cutting tools 4, 5 are uniformly extended in the opposite direction until touching the column.

According to the second embodiment of the device, the upper piston 2 acts on the movable part 14 of the upper shackle 12 that carries the upper cutting tool 4 and the lower piston 9 acts on the movable part 14 of the bottom shackle 13 that carries the lower cutting tool 5. Under the action of the pistons 2, 9, movable parts 14 of the shackles 12, 13 are rotated evenly extending mounted on them cutting tools 4, 5 until touching the column.

According to the third embodiment of the device, the upper and lower pistons 2, 9, moving steadily towards each other, carry the oppositely directed upper and lower wedge-type shackles 16 and 17, respectively. The V-surfaces 19 located on the movable parts 18 of the wedge-type shackles 16, 17 come into contact and interact, moving relative to each other, extending the movable part of the 18 wedge-type shackles 16, 17 out of the perforator's casing 1 in opposite directions. At the same time, the cutting tools 4, 5, placed on the movable parts 18 of the wedge-type sockets 16, 17 are extended until touching the column.

According to the fourth embodiment of the device, the upper and lower pistons 2, 9, moving steadily towards each other, carry the oppositely directed upper and lower wedge-type shackles 16 and 17, respectively. The V-surfaces 19 located on the movable parts 18 of the wedge-type shackles 16, 17 come into contact with V-surfaces 21 of the wedge-type balance beam (balance beams) 20, and interacting with them, move in respect of them, turning the movable parts 18 of wedge-type sockets 16, 17 and a wedge-type balance beam 20, extending the movable part 18 of the wedge-type shackles 16, 17 and the shoulders of the wedge-type balance beam 20 out of the perforator's casing 1 in the opposite directions. At the same time, the cutting tools 4, 5, placed on the moving parts 18 of the wedge-type shackles 16, 17, and wedge-type balance beam (wedge-type balance beams) 20 are extended until touching the column.

Up-and-down movement along the column's axis is transferred to the perforator, at that the working pressure in accordance with the applicable perforation technology is maintained. Both the cutting tools 4, 5 being introduced with an equal force under pressure into the wall of the column and form at least two longitudinal slots of the same quality in it. After opening the column, jetting treatment of the bottom-hole formation zone with the destruction of cement sheath and rock behind the column with the formation of cavities can be made through the jet nozzle 11.

Upon completion of work on the perforation interval, the inventive device is brought in the transportation position.

Figure 5:
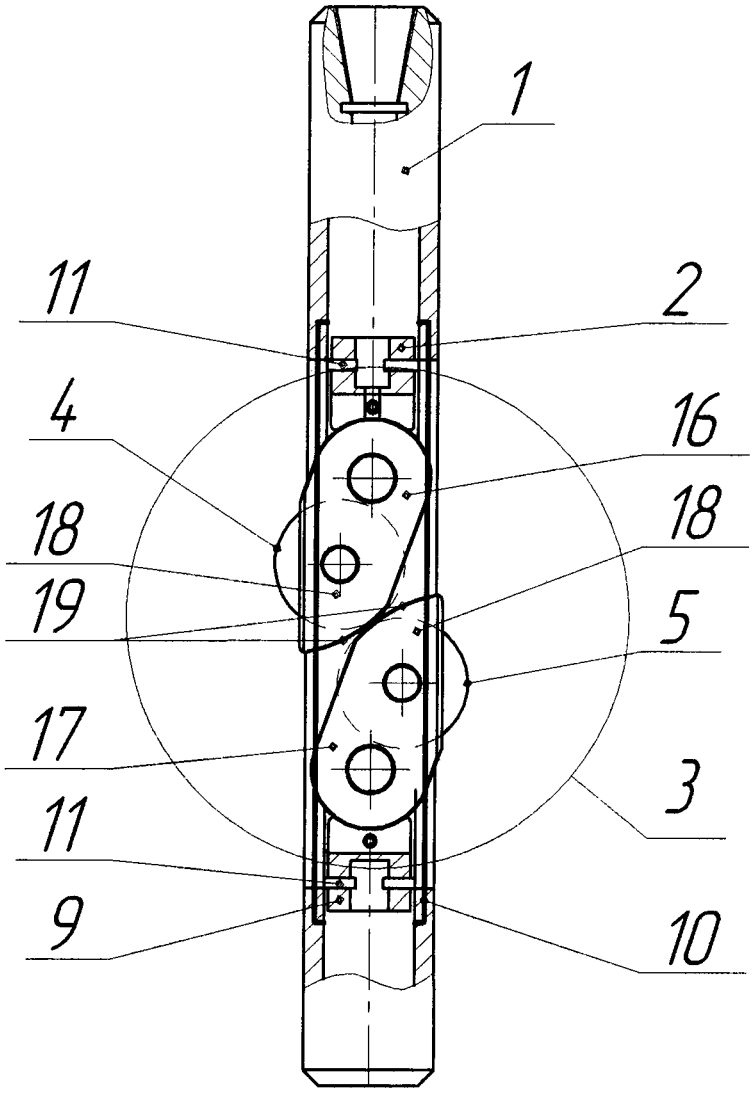
FIG. 5 illustrates the third embodiment of the invention, with the extension mechanism of cutting tools designed in the form of oppositely directed wedge-type shackles, which interact with each other.
Figure 6:
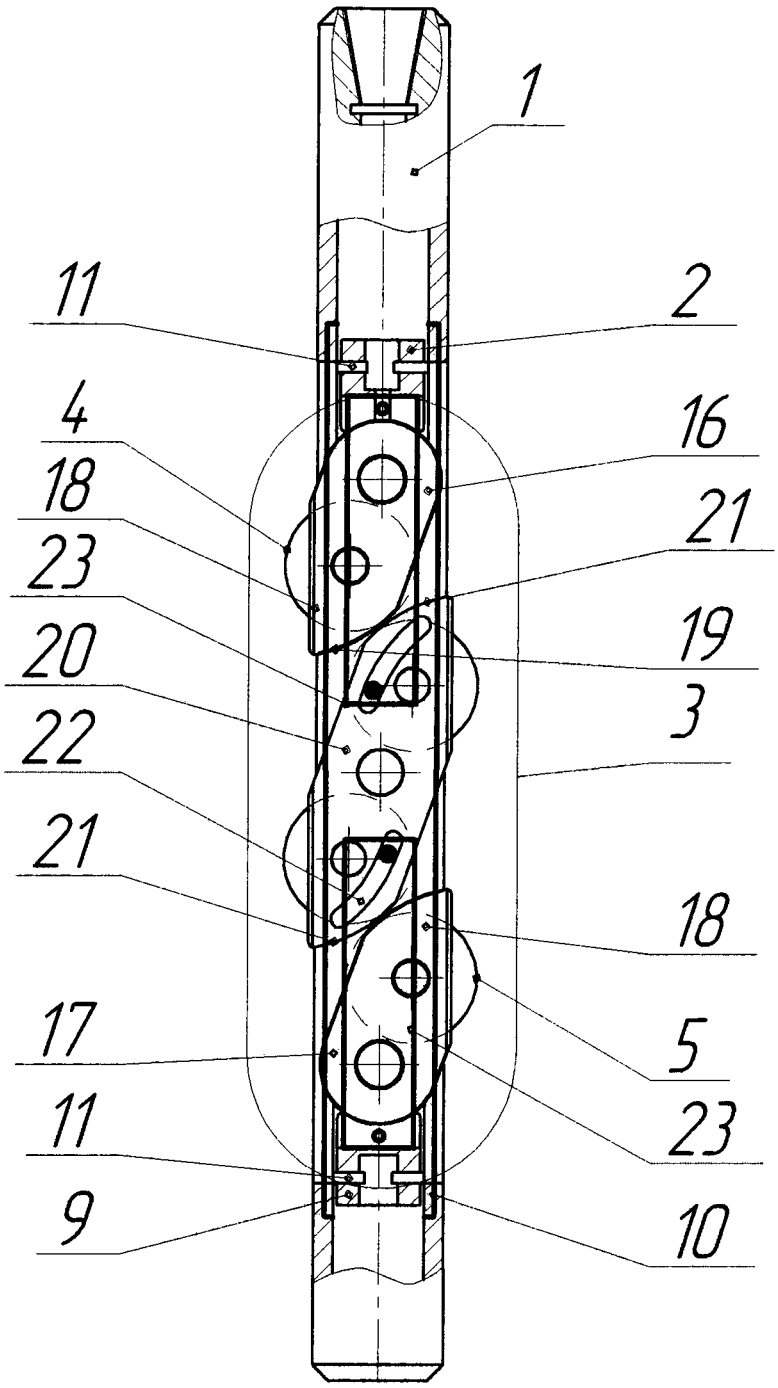
FIG. 6 illustrates the fourth embodiment of the invention, with the extension mechanism of cutting tools designed in the form of oppositely directed wedge-type shackles and a wedge-type balance beam located between them, interacting with each other.

Bringing the device into the transportation position can be carried out by means of the mechanism, which example is shown in FIGS. 5 and 6 for the third and the fourth embodiments of the proposed device, respectively.

According to the third embodiment of the device, during a reduction of the operating pressure, the pistons 2, 9 make the reverse movement, pulling and taking apart the wedge-type shackles 16, 17. At the same time the connecting rod 23 attached at one end to one of the pistons 2, 9, for example, to the upper piston 2, and at the other end secured in the groove 22, formed in the opposite lower wedge-type shackle 17, moving along the slot 22, returns the lower wedge-type shackle 17 by trajectory of the groove 22 into the initial transportation position (FIG. 5).

According to the fourth embodiment of the device, if, for example, the extension mechanism of cutting tools 4. 5 comprises the wedge-type shackles 16, 17 and one balance beam 20 placed between them (FIG. 6), during a reduction of the operating pressure, the pistons 2, 9, make the reverse movement, pulling and taking apart the wedge-type shackles 16, 17. At the same time the connecting rod 23 attached at one end to one of the pistons 2, 9 and at the other end secured in the groove 22 made in the balance beam 20, moving along the grooves 22, return the balance beam 20 by trajectory of the grooves 22 in the initial transportation position.

In all embodiments of the proposed device, other mechanisms for returning the retractable parts into the transportation position can be used.

After bringing into the transportation position, the device is removed from the well or transferred to a new perforation interval to continue working.

The invention claimed is:

1. A hydro-mechanical slot-type perforator comprising: a casing; an upper piston movable within the casing; a lower piston movable within the casing; a cutting unit located below the upper piston and above the lower piston; said cutting unit includes: cutting tools, and an extension mechanism for extending and retracting said cutting tools; said extension mechanism includes: an upper shackle having an upper movable part, and a lower shackle having a lower movable part; wherein: said cutting tools are mounted on the upper movable part and on the lower movable part; said upper shackle is configured to rotate around an axle during a downward stroke of said upper piston enabling the upper piston to act upon the upper shackle; said lower shackle is configured to rotate around an axle during an upward stroke of said lower piston enabling the lower piston to act upon the lower shackle; and the lower piston is moved by pressurized fluid supplied thereto through at least one hydraulic channel made in the casing, or through a hydraulic system.

2. The hydro-mechanical slot-type perforator according to claim 1, having a longitudinal axis; wherein the axle of said lower shackle and the axle of said upper shackle are located on one line being perpendicular to the longitudinal axis.

3. The hydro-mechanical slot-type perforator according to claim 1, wherein the axle of said lower shackle and the axle of said upper shackle coincide, and the lower movable part and the upper movable part are capable of rotation independently of each other.

4. The hydro-mechanical slot-type perforator according to claim 1, further comprising at least two jet nozzles arranged in the casing, or in the upper pistons, or in the lower piston.

5. A hydro-mechanical slot-type perforator comprising: a casing; an upper piston movable within the casing; a lower piston movable within the casing; a cutting unit located below the upper piston and above the lower piston; said cutting unit includes: a first cutting tool and a second cutting tool; and an extension mechanism for extending and retracting said cutting tools; said extension mechanism includes: a wedge-type upper shackle having a wedge-shaped upper movable part coupled with the first cutting tool; said wedge-type upper shackle is rotatably mounted on the upper piston; and a wedge-type lower shackle having a wedge-shaped lower movable part coupled with the second cutting tool; said wedge-type lower shackle is rotatably mounted on the lower piston; wherein: said wedge-shaped lower movable part is directed oppositely to the wedge-shaped upper movable part; and said wedge-shaped upper movable part and said wedge-shaped lower movable part are capable of moving relative to each other with an interaction with each other during countermotion of the upper piston and the lower piston.

6. The hydro-mechanical slot-type perforator according to claim 5, further comprising a retractable mechanism for bringing said wedge-shaped upper movable part and said wedge-shaped lower movable part into a transportation position; said retractable mechanism includes either: a) a guide groove, made in said wedge-type upper shackle, and a connecting rod, attached to the wedge-type lower shackle or to the lower piston, said connecting rod is capable of moving through the groove thereby to ensuring a return of the wedge-type upper shackle and the wedge-type lower shackle into the transportation position during countermotion of the upper piston and the lower piston; or b) a guide groove, made in said wedge-type lower shackle, and a connecting rod, attached to the wedge-type upper shackle or to the upper piston, said connecting rod is capable of moving through the groove thereby to ensuring a return of the wedge-type upper shackle and the wedge-type lower shackle into the transportation position during countermotion of the upper piston and the lower piston.

7. The hydro-mechanical slot-type perforator according to claim 6, further comprising at least two jet nozzles, arranged in the casing, or in the upper pistons, or in the lower piston.

8. The hydro-mechanical slot-type perforator according to claim 5, further comprising at least two jet nozzles, arranged in the casing, or in the upper pistons, or in the lower piston.

9. A hydro-mechanical slot-type perforator comprising: a casing; an upper piston movable within the casing; a lower piston movable within the casing by pressurized fluid supplied thereto through at least one hydraulic channel made in the casing, or through a hydraulic system; a cutting unit located below the upper piston and above the lower piston; said cutting unit includes: a plurality of cutting tools, and an extension mechanism for extending and retracting said plurality of cutting tools; said extension mechanism includes: a rotatable upper shackle having a wedge-shaped upper movable part, said upper shackle is mounted on the upper piston; a rotatable lower shackle having a wedge-shaped lower movable part, said lower shackle is mounted on the lower piston, wherein the wedge-shaped lower movable part is directed opposite to the wedge-shaped upper movable part; at least one rotatable wedge-type balance beam having an upper wedge-shaped shoulder interactable with the wedge-shaped upper movable part, and a lower wedge-shaped shoulder interactable with the wedge-shaped lower movable part; said at least one rotatable wedge-type balance beam is located below the upper shackle and above the lower shackle; and wherein: one cutting tool from said plurality of cutting tools is mounted in: the wedge-shaped upper movable part, the wedge-shaped lower movable part, the upper wedge-shaped shoulder, and the lower wedge-shaped shoulder, such that all adjacent said cutting tools are oppositely extended during countermotion of the upper piston and the lower piston.

10. The hydro-mechanical slot-type perforator according to claim 9, further comprising a retractable mechanism for bringing said wedge-shaped upper movable part, said wedge-shaped lower movable part, and said wedge-type balance beam into a transportation position; said retractable mechanism includes: at least one guide groove, made in: said wedge-type upper shackle, or in said wedge-type lower shackle, or in said wedge-type balance beam; and at least one connecting rod, attached to the wedge-type lower shackle, or to the lower piston, or attached to the wedge-type upper shackle, or to the upper piston, or attached to the wedge-type balance beam; and wherein said at least one connecting rod is capable of moving through said at least one groove thereby ensuring a return of the wedge-type upper shackle, the wedge-type lower shackle, and the wedge-type balance beam into the transportation position during countermotion of the upper piston and the lower piston.

11. The hydro-mechanical slot-type perforator according to claim 10, further comprising at least two jet nozzles, arranged in the casing, or in the upper pistons, or in the lower piston.

12. The hydro-mechanical slot-type perforator according to claim 9, further comprising at least two jet nozzles, arranged in the casing, or in the upper pistons, or in the lower piston.

* * * * *